US006365546B1

(12) United States Patent
Kometani

(10) Patent No.: US 6,365,546 B1
(45) **Date of Patent: *Apr. 2, 2002**

(54) THERMAL TRANSFER IMAGE RECEIVING SHEET

(75) Inventor: Shinji Kometani, Shinjuku-Ku (JP)

(73) Assignee: Dai Nippon Printing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/172,765

(22) Filed: Oct. 15, 1998

(30) Foreign Application Priority Data

Oct. 16, 1997 (JP) ..... 9-297969

(51) Int. Cl.[7] ..... B41M 5/035; B41M 5/38

(52) U.S. Cl. ..... 503/227; 428/195; 428/913; 428/914; 427/152

(58) Field of Search ..... 8/471; 428/195, 428/913, 914; 503/227; 427/152

(56) References Cited

U.S. PATENT DOCUMENTS 5,837,649 A * 11/1998 Nozaki ..... 503/227

FOREIGN PATENT DOCUMENTS

EP 0 568 093 A1 11/1993
EP 0 664 223 A1 7/1995

OTHER PUBLICATIONS

Patent Abstracts of Japan; vol. 17, No. 260 (M–1414); May 21, 1993 & JP 05 000491 A (Oji Yuka Synthetic Paper Company Limited): Jan. 8, 1993 *abstract*.

* cited by examiner

*Primary Examiner*—Bruce H. Hess
(74) *Attorney, Agent, or Firm*—Parkhurst & Wendel, L.L.P.

(57) ABSTRACT

A thermal transfer image receiving sheet is provided which, when used with various printers, can be carried with improved accuracy, can form an image without misregistration, can prevent a trace of a spike of a metallic roller in the printer from reaching the image receiving surface and hence can form an image having quality not significantly influenced by the trace of the spike.

The thermal transfer image receiving sheet 1 comprises a substrate 3, a receptive layer 4 provided on at least one side of the substrate 3, and a grip layer 2 provided on the other side of the substrate 3. In this case, the grip layer 2 is constituted by an unstretched synthetic resin layer having a softening point of 110° C. or above. This constitution permits a spike of a metallic roller in a printer to satisfactorily bite the unstretched synthetic resin layer having a softening point of 110° C. or above as the grip layer 2. This prevents slippage between the metallic roller and the thermal transfer image receiving sheet 1 at the time of a reciprocation for image formation and hence can prevent misregistration. Therefore, the thermal transfer image receiving sheet can be carried with improved accuracy, and a thermally transferred image can be formed without misregistration.

6 Claims, 2 Drawing Sheets

THERMAL TRANSFER IMAGE RECEIVING SHEET

BACKGROUND OF THE INVENTION

This invention relates to a thermal transfer image receiving sheet for use in a thermal transfer system wherein a thermal transfer image receiving sheet is superposed on a thermal transfer sheet and a colorant is thermally transferred from the thermal transfer sheet onto the thermal transfer image receiving sheet to form an image on the thermal transfer image receiving sheet, and a process for producing the same. More particularly, the present invention relates to a thermal transfer image receiving sheet capable of preventing misregistration which is likely to occur in the formation of an image on a thermal transfer image receiving sheet, and a process for producing the same.

Formation of letters or images on an object by a thermal transfer system has hitherto been carried out in the art. A thermal dye transfer system (a thermal sublimation transfer system) and a thermal ink transfer system (a hot melt transfer system) have been extensively used as the thermal transfer system. The thermal dye transfer system is such that a sublimable dye is used as a colorant, and the dye in a sublimable dye layer provided in a thermal transfer sheet is thermally transferred onto an object, such as a thermal transfer image receiving sheet, by means of a heating device, such as a thermal head, wherein generation of heat is regulated according to image information, thereby forming an image on the object.

In the thermal dye transfer system, the amount of the dye transferred can be regulated for each dot by heating in very short time. The image thus formed is very sharp, because the colorant used is a dye, and, at the same time, is highly transparent. Therefore, the image has excellent halftone reproduction and gradation, high definition, and high quality comparable to that of full-color photographic images using a silver salt.

By virtue of development of various hardwares and softwares associated with multimedia, the thermal transfer system has found an expanded market as a full color hard copy system of digital images, including computer graphics, still pictures by satellite communication, and CDROM, and analog images, such as video images.

Specific applications of the thermal transfer image receiving sheet in the thermal transfer system are various, and representative examples thereof include proof printing, output of an image, output of a design, such as CAD/CAM, output applications for various medical instruments for analysis, such as CT scan and endoscope cameras, output applications for measuring equipment, alternatives for instant photography, output of photograph of a face to identification (ID) cards, credit cards, and other cards, and applications in composite photographs, pictures for keepsake, and picture postcards in amusement facilities, such as pleasure grounds, game centers, museums, aquariums, and the like.

One of the methods for forming an image in the thermal transfer system is to superimpose colors on top of each other or one another side by side. In this method, a color image is formed for each image face. Therefore, the thermal transfer image receiving sheet is reciprocated, and an image is transferred one color by one color from the thermal transfer sheet being successively wound in one direction to put colors on top of each other or one another. According to this method, advantageously, image printing speed is high, and there is no overlapping between lines experienced in the serial process. Therefore, a good image can be formed so far as the positioning accuracy is high. This method, however, suffers from problems including that, due to the nature of reciprocation of the thermal transfer image receiving sheet, the paper positioning accuracy is so low that the so-called misregistration is likely to occur, and, in addition, it is difficult to realize a reduction in size and cost of the image printer.

The following several printers have hitherto been proposed for use in the above method.

For example, one of them is a printer wherein the thermal transfer image receiving sheet is fastened in its one end with a chuck and in this state is reciprocated. In this printer, since the thermal transfer image receiving sheet is reciprocated using an independent chuck, the carrying accuracy is high. The printer can easily form an image on a thermal transfer image receiving sheet having a relatively large size, for example, a thermal transfer image receiving sheet of A3 size or larger. This printer, however, is disadvantageous in that the mechanism is complicated and, hence, the size of the printer should be increased, it is difficult to form an image on a thermal transfer image receiving sheet of small size, and the price of the printer is high.

Another printer is one wherein one end of the thermal transfer image receiving sheet is fixed to and wound on a chuck provided on the surface of a platen roller and reciprocated by rotation of the platen roller. Before carrying accuracy is discussed, this type of printer has a drawback that, when the thermal transfer image receiving sheet is delivered, it is likely to be jammed within the printer.

Still another printer is one wherein the thermal transfer image receiving sheet is fastened with a grip roller comprising a rubber roller and a metallic roller and reciprocated by utilizing the rotation of the roller. By virtue of a simple structure of this type of printer, the size thereof can be reduced, and the price of the printer is low. For this reason, at the present time, this printer has been most extensively used in the art.

In this printer, the grip roller comprises: a rubber roller for preventing the sheet from being slipped; and a metallic roller having fine protrusions having a height of about 40 to 100 $\mu$m (hereinafter referred to as "spike") formed thereon by etching that function to bite the thermal transfer image receiving sheet, thereby carrying the thermal transfer image receiving sheet with high accuracy. This grip roller, however, has originally been used mainly in monochrome printing apparatuses where the reciprocation of the thermal transfer image receiving sheet is not required, such as diazo copying of drawings and printers for drafting. Therefore, the carrying accuracy of a printer using this grip roller is not very good, and printing of an image while reciprocating the thermal transfer image receiving sheet has been likely to create misregistration. Increasing the pushing force of the rubber roller and the metallic roller can improve the carrying accuracy in the reciprocation of the thermal transfer image receiving sheet. In this case, however, the spike of the metallic roller bites the thermal transfer image receiving sheet, creating and leaving a trace of the spike. In particular, in the case of a thin thermal transfer image receiving sheet, the trace of the spike poses a serious problem. In some cases, the trace reaches the image receiving face on the surface of the thermal transfer image receiving sheet, resulting in deteriorated print quality.

In order to cope with the above problems, in view of properties of commercially available printers, for example, the carrying accuracy of the printer, the pushing force of the grip roller for improving the carrying accuracy, the degrees of the trace of spike created by increasing the pushing force of the grip roller and the like, thermal transfer image receiving sheets compatible with respective various printer types have hitherto been supplied. For example, the thickness of the thermal transfer image receiving sheet has been increased so that, even when the pushing force of the grip roller is increased to improve the carrying accuracy, the influence of the spike does not reach the image receiving face.

Supplying a wide variety of thermal transfer image receiving sheets compatible with respective various printers, however, results in remarkably increased development cost and production cost. Further, an increase in thickness of the thermal transfer image receiving sheet in order to reduce the influence of the spike limits the thickness and layer construction suitable for conventional thermal transfer image receiving sheets, often leading to restriction of functions commonly possessed by the thermal transfer image receiving sheet, for example, handle, nerve, gloss and other properties.

DISCLOSURE OF INVENTION

Accordingly, an object of the present invention is to solve the above problems of the prior art and to provide a thermal transfer image receiving sheet that, when used with various printers, can be carried with improved accuracy, can form an image without misregistration, can prevent a trace of a spike of a metallic roller in the printer from reaching the image receiving face and hence can form an image having quality not significantly influenced by the trace of the spike.

Another object of the present invention is to provide a process for producing a thermal transfer image receiving sheet that can easily produce a thermal transfer image receiving sheet which can form an image free from misregistration and an image free from a trace of a spike and having good quality.

According to one aspect of the present invention, there is provided a thermal transfer image receiving sheet comprising: a substrate; a receptive layer provided on at least one side of the substrate; and a grip layer provided on the other side of the substrate, the grip layer being constituted by an unstretched synthetic resin layer having a softening point of 110° C. or above.

The grip layer is preferably an unstretched polyolefin resin layer or an unstretched polyester resin layer.

The unstretched polyolefin resin layer is preferably an unstretched polypropylene resin layer.

Preferably, a polyethylene resin layer is provided between the substrate and the grip layer.

Preferably, the grip layer is formed by extrusion lamination.

Preferably, the polyethylene resin layer and the grip layer are formed by coextrusion lamination.

Preferably, the grip layer has a thickness of 15 to 50 $\mu$m.

According to another aspect of the present invention, there is provided a process for producing a thermal transfer image receiving sheet, comprising the steps of: forming a receptive layer on at least one side of a substrate; and extrusion-laminating a synthetic resin having a softening point of 110° C. or above on the other side of the substrate to form a grip layer constituted by an unstretched synthetic resin layer.

Preferably, in the step of the extrusion lamination, a polyethylene resin and a synthetic resin having a softening point of 110 ° C. or above are coextrusion-laminated on at least one side of the substrate to prepare a thermal transfer image receiving sheet comprising a polyethylene resin layer and a grip layer constituted by an unstretched synthetic resin layer.

In the above process, the synthetic resin having a softening point of 110° C. or above is preferably a polyolefin resin or a polyester resin.

In the above process, the polyolefin resin is preferably a polypropylene resin.

The thermal transfer image receiving sheet of the present invention comprises a substrate, a receptive layer provided on at least one side of the substrate, and a grip layer provided on the other side of the substrate. In this case, the grip layer is constituted by an unstretched synthetic resin layer having a softening point of 110° C. or above. This constitution permits a spike of a metallic roller in a printer to satisfactorily bite the unstretched synthetic resin layer having a softening point of 110° C. or above as the grip layer. This prevents slippage between the metallic roller and the thermal transfer image receiving sheet at the time of a reciprocation for image formation and hence can prevent misregistration. Therefore, the thermal transfer image receiving sheet can be carried with improved accuracy, and a thermally transferred image can be formed without misregistration.

In this case, the grip layer is preferably constituted by an unstretched polyolefin resin layer or an unstretched polyester resin layer, particularly preferably an unstretched polyolefin resin layer. In the unstretched polyolefin resin layer, an unstretched polypropylene resin layer is preferred.

The provision of a polyethylene resin layer between the substrate and the grip layer is advantageous in that the polyethylene resin layer can enhance the adhesion between the substrate and the grip layer. Further, the polyethylene resin layer can prevent a trace of a spike from extending from the backside and reaching the image receiving face.

Next, the process for producing a thermal transfer image receiving sheet according to the present invention comprises the steps of: a forming a receptive layer on at least one side of the substrate; and extrusion-laminating a synthetic resin having a softening point of 110° C. or above on the other side of the substrate to form a grip layer constituted by an unstretched synthetic resin layer. The extrusion lamination of the synthetic resin having a softening point of 110° C. or above permits a grip layer of a synthetic resin in an unstretched state to be easily formed on the other side of the substrate. This unstretched layer of the synthetic resin is easily bitten by the spike. Thus, the process of the present invention can easily form a thermal transfer image receiving sheet which can form a thermally transferred image without misregistration.

Further, formation of a thermal transfer image receiving sheet having a polyethylene resin layer and an unstretched synthetic resin layer as a grip layer by coextrusion lamination of a polyethylene resin and a synthetic resin having a softening point of 110° C. or above on at least one side of the substrate is preferred. Since the polyethylene resin layer, which can improve the adhesion between the substrate and the grip layer and at the same time can prevent a trace of the spike from reaching the image receiving face, can be easily formed by coextrusion lamination together with the grip layer which can be well bitten by the spike. This can realize the formation of a thermally transferred image without misregistration and the formation of a thermally transferred image free from a trace of a spike and having good quality.

BEST MODE FOR CARRYING OUT THE INVENTION

The present invention will be described in more detail with reference to the following preferred embodiments.

Figure 1:
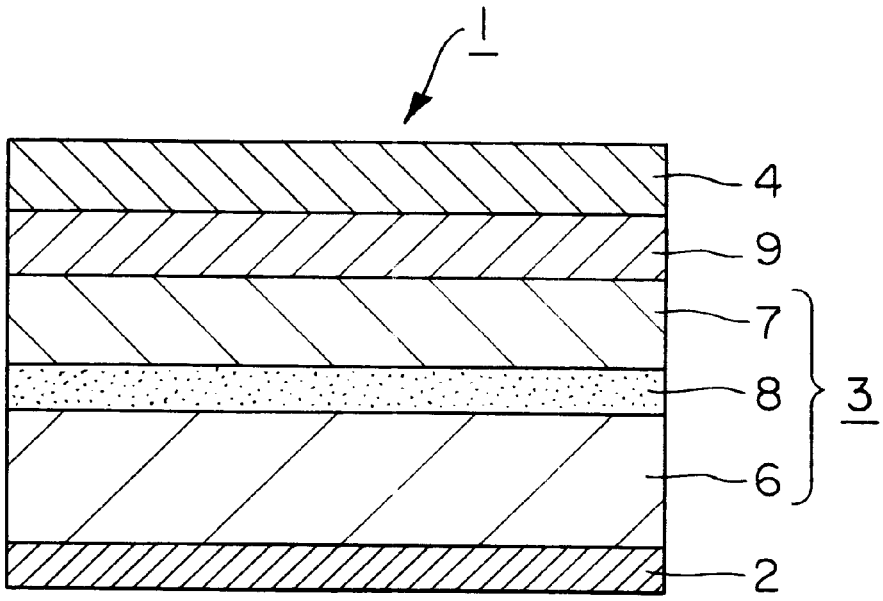
FIG. 1 is a cross-sectional view of an embodiment of the thermal transfer image receiving sheet according to the present invention.

FIG. 1 is a cross-sectional view of one embodiment of the thermal transfer image receiving sheet according to the present invention. The thermal transfer image receiving sheet comprises: a substrate 3 comprising a microvoid layer 7 provided on a support 6 through an adhesive layer 8; a receptive layer 4 provided on the substrate 3 on its microvoid layer 7 side through an intermediate layer 9; and a grip layer 2, constituted by an unstretched synthetic resin layer having a softening point of 110° C. or above, provided on the other side of the substrate 3.

Figure 2:
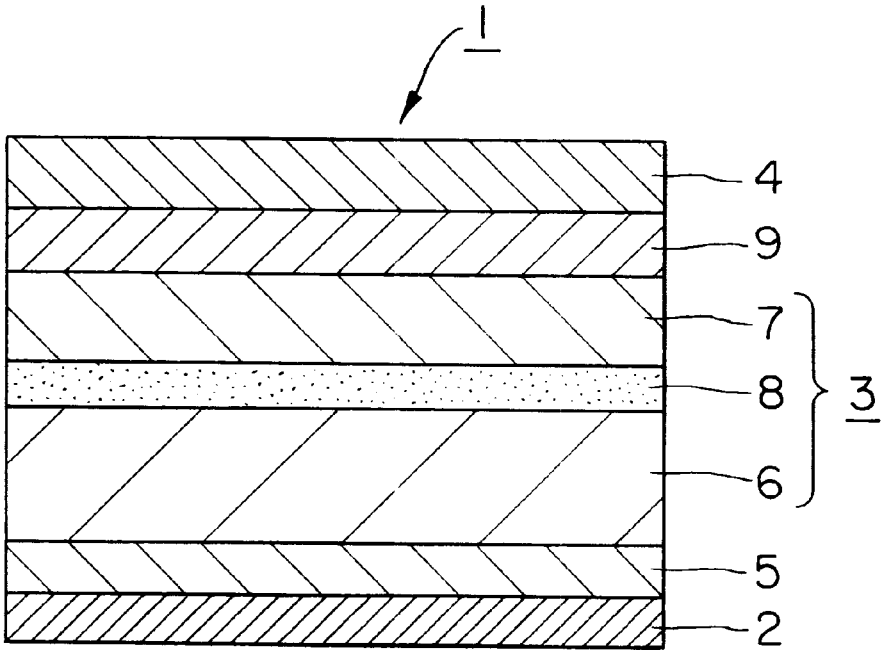
FIG. 2 is a cross-sectional view of another embodiment of the thermal transfer image receiving sheet according to the present invention.

On the other hand, the thermal transfer image receiving sheet shown in FIG. 2 is identical to the thermal transfer image receiving sheet shown in FIG. 1 in the construction of the substrate 3, and the construction of a laminate of the substrate 3, the intermediate layer 9, and the receptive layer 4. The thermal transfer image receiving sheet shown in FIG. 2 is different from the thermal transfer image receiving sheet shown in FIG. 1 in that the grip layer 2 constituted by an unstretched synthetic resin layer having a softening point of 110° C. or above is provided on the other side of the substrate 3 through a polyethylene resin layer 5.

Figure 3:
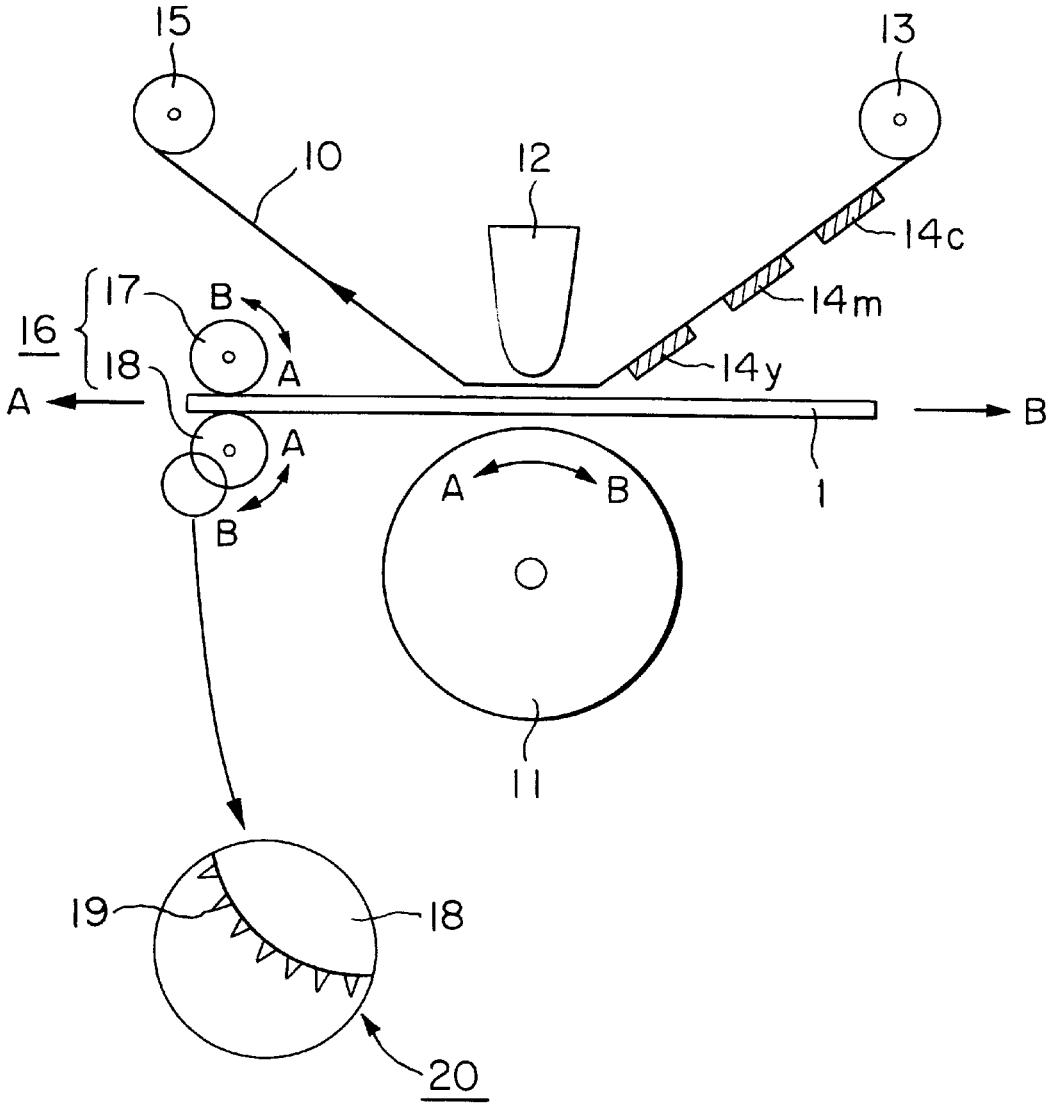
FIG. 3 is a schematic diagram showing the construction of a printer for forming an image on the thermal transfer image receiving sheet according to the present invention.

FIG. 3 is a schematic diagram showing a printing mechanism of a printer suitable for use with the thermal transfer image receiving sheet according to the present invention. This printer is of such a type that the thermal transfer image receiving sheet 1 carried by means of a grip roller 16. The grip roller 16 comprises: a rubber roller 17 for preventing the sheet from being slipped; and a metallic roller 18 having thereon fine protrusions with a height of about 40 to 100 $\mu$m (hereinafter referred to as "spike" 19) formed by etching that function to bite the thermal transfer image receiving sheet 1, thereby carrying the thermal transfer image receiving sheet with high accuracy.

In the formation of an image on the thermal transfer image receiving sheet 1, a thermal transfer sheet 10 comprising colorant layers of three colors of yellow 14*y*, magenta 14*m*, and cyan 14*c* provided in a face serial manner and the thermal transfer image receiving sheet 1 are sandwiched between a heating device 12 (such as a thermal head or a laser head) and a platen roller 11 and pressed under a given pressure. Subsequently, the platen roller 11 and the grip roller 16 are rotated in a direction indicated by a letter A to permit the thermal transfer sheet 10 and the thermal transfer image receiving sheet 1 to be moved toward the direction A. At that time, the heating device 12 is heated in response to image information. This transfers a colorant layer of the first color provided in the thermal transfer sheet 10, for example, a colorant in yellow 14*y*, onto the receptive layer 4 provided in the thermal transfer image receiving sheet 1 to form an image of the first color.

The thermal transfer image receiving sheet 1 is sandwiched between the rubber roller 17 pushed against the receptive layer 4 side and the metallic roller 18 pushed against the grip layer 2 side, the rubber roller 17 and the metallic roller 18 constituting the grip roller 16. The thermal transfer image receiving sheet 1 is then moved toward the direction A by the grip roller 16 rotated according to the rotation of the platen roller 11. On the other hand, the thermal transfer sheet 10 is wound from the feed roller 13 on a winding roller 15.

Next, the pushing force of the heating device 12 and the platen roller 11 is released. The thermal transfer sheet 10 is once separated from the thermal transfer image receiving sheet 1. The grip roller 16, together with the platen roller 11, is rotated in a direction indicated by a letter B to return the thermal transfer image receiving sheet 1 to a position where an image of the second color is to be formed. The thermal transfer sheet 10 is searched for the front end of a colorant layer of the second color.

Here again, the thermal transfer sheet 10 and the thermal transfer image receiving sheet 1 are pressed by the heating device 12 and the platen roller 11 and moved toward the direction A by the rotation of the platen roller 11 and the grip roller 16. At that time, in the same manner as described above, a colorant of the second color, for example, magenta 14 m, is transferred onto the receptive layer 4 of the thermal transfer image receiving sheet 1 to form an image of the second color.

The above procedure is repeated to form a color image on the receptive layer 4 of the thermal transfer image receiving sheet 1.

Layers constituting the thermal transfer image receiving sheet according to the present invention, a method for forming these layers, and a process for producing a thermal transfer image receiving sheet will be described.

Grip layer

An unstretched synthetic resin layer is provided as a grip layer 2 on the backside of the thermal transfer image receiving sheet 1. The provision of the grip layer can prevent slippage between the thermal transfer image receiving sheet 1 and the metallic roller 18. This permits the thermal transfer image receiving sheet 1 to be carried with improved accuracy in the reciprocation at the time of color image formation, realizing the formation of a color image without misregistration.

The grip layer is constituted by an unstretched synthetic resin layer having a softening point of 110° C. or above. This unstretched synthetic resin layer is satisfactorily bitten by the spike 19 of the metallic roller 18, preventing slippage between the metallic roller 18 and the thermal transfer image receiving sheet 1.

A stretched synthetic resin layer has a high Young's modulus and is too hard to be satisfactorily bitten by the spike 19. Therefore, when the grip layer is constituted by a stretched synthetic resin layer, slippage occurs between the metallic roller 18 and the thermal transfer image receiving sheet 1 in the reciprocation at the time of color image formation. This results in deteriorated carrying accuracy and creation of misregistration. On the other hand, an unstretched synthetic resin layer having a softening point of below 110° C. has wax-like properties, is fragile, has low strength, and, upon bitten by the spike 19 in the reciprocation, is likely to be separated.

By contrast, a grip layer constituted by an unstretched synthetic resin layer having a softening point of 110° C. or above has suitable Young's modulus and suitable hardness and hence can be satisfactorily bitten by the spike 19. The grip layer 2 having suitable Young's modulus and suitable hardness can satisfactorily hold the spike to eliminate the backlash of the spike 19, preventing the misregistration between the thermal transfer image receiving sheet 1 and the metallic roller 18 at the time of rotation of the metallic roller 18. Further, unlike wax, the grip layer is not fragile. Therefore, there is no fear of the grip layer 2 being broken by biting of the spike 19.

The unstretched synthetic resin layer having a softening point of 110° C. or above is preferably an unstretched polyolefin resin layer or an unstretched polyester resin layer, particularly preferably an unstretched polyolefin resin layer. Especially, in the case of an unstretched polypropylene resin layer, biting by the spike 19 is very good. The polyolefin resin is inexpensive and hence is advantageous also in cost.

The grip layer may be formed on the support 6 by any of a method which comprises previously forming an unstretched synthetic resin layer into a film and laminating the unstretched synthetic resin film onto the support 6, a method wherein a coating liquid is coated to form a grip layer, and an extrusion lamination method. Among these methods, the extrusion lamination method is most preferred because it can easily form a synthetic resin layer in an unstretched state, has been already established, and is cost-effective. The coating method takes a lot of time for drying after coating and hence causes a lowering in line speed. Therefore, although the coating method has somewhat lower productivity than the extrusion lamination method, the coating method is suitable for practical use. For the film lamination method, the synthetic resin film in an unstretched state is somewhat elongated in the lamination and becomes hard, causing the biting by the spike to be somewhat deteriorated, which often results in creation of slight misregistration. This method, however, is suitable for practical use.

The thickness of the grip layer is preferably 15 to 150 $\mu$m. When the thickness is less than 15 $\mu$m, the biting of the grip layer by the spike 19 is unsatisfactory. This causes slippage between the metallic roller 18 and the thermal transfer image receiving sheet 1 in the reciprocation at the time of color image formation, resulting in lowered carrying accuracy, which leads to a fear of the misregistration being created. On the other hand, when the thickness exceeds 50 $\mu$m, the productivity in the formation of the grip layer is lowered, which is causative of increased cost. A grip layer thickness exceeding 50 $\mu$m increases the thickness of the whole thermal transfer image receiving sheet. This renders the thermal transfer image receiving sheet bulky and hence unfavorably lowers the handle. For the above reason, the thickness of the grip layer is limited to 15 to 50 $\mu$m.

Polyethylene resin layer

A polyethylene resin layer 5 may be provided as a substrate layer between the grip layer 2 and the support 6. This polyethylene resin layer 5 can function to enhance the adhesion between the support 6 and the grip layer 2. Further, it can prevent the spike 19 from passing through each layer of the thermal transfer image receiving sheet and reaching the image receiving face.

All of high-density polyethylene resin, medium-density polyethylene resin, and low-density polyethylene resin are suitable for practical use as the polyethylene resin constituting the polyethylene resin layer 5. A grip layer 2, constituted by an unstretched polypropylene resin layer, in combination with a polyethylene resin layer 5 formed of a resin composed mainly of a high-density polyethylene resin is particularly preferred. This offers best biting by the spike 19, improves the carrying accuracy, and can realize formation of an image without misregistration.

Formation of the polyethylene resin layer 5 using a resin composed mainly of a high-density polyethylene resin, which, although it is not so hard as the polypropylene resin, has the highest hardness among the polyethylene resins, can improve the adhesion between the grip layer 2 and the support 6. In this case, in addition, the nonstretched polypropylene resin layer as the grip layer and the polyethylene resin layer as the substrate layer formed of a resin composed mainly of high-density polyethylene resin cooperate with each other to markedly improve biting by the spike 19. Further, at that time, the unfavorable phenomenon that the spike 19 passes through the thermal transfer image receiving sheet 1 and reaches the image receiving face, can be most satisfactorily prevented.

The polyethylene resin layer 5 may be formed on the backside of the support 6 by any of a method wherein a coating liquid is coated and the coating is then dried, a method which comprises previously forming a film and then laminating the film onto the support 6, and an extrusion lamination method. Further, the polyethylene resin layer 5 may be formed on the support 6 by coextrusion lamination together with a synthetic resin having a softening point of 110° C. or above as the grip layer. Among them, the formation of the polyethylene resin layer 5 and the grip layer by the coextrusion lamination method is most preferred because this method can form the polyethylene resin layer 5 simultaneously with the formation of the grip layer, can form the grip layer as a synthetic resin layer in an unstretched state, has already been established, and is cost-effective. The coating method requires the repetition of coating and drying. This lowers line speed. Therefore, although the coating method has somewhat lower productivity than the coextrusion lamination method, the coating method is suitable for practical use.

In order to improve the adhesion between the polyethylene resin layer 5 and the unstretched polypropylene resin layer, a polyolefin resin modifier (Tafmer A-4085, manufactured by Mitsui Petrochemical Industries, Ltd.) may be blended with the polyethylene resin to form a polyethylene resin layer 5.

The thickness of the polyethylene resin layer 5 is preferably 10 to 18 $\mu$m.

Receptive layer

The receptive layer 4 in the thermal transfer image receiving sheet of the present invention may be formed of a varnish, composed mainly of a resin having good dyeability with a colorant, with various additives, such as release agents, being optionally added thereto. Representative examples of resins having good dyeability include polyolefins, such as polypropylene, halogenated resins, such as polyvinyl chloride and polyvinylidene chloride resins, vinyl resins, such as polyvinyl acetate and polyacrylic esters, and copolymers thereof, polyester resins, such as polyethylene terephthalate and polybutylene terephthalate, polystyrene resins, polyamide resins, copolymers of olefins, such as ethylene or propylene, with other vinyl monomers, polyurethane, polycarbonate, acrylic resins, ionomers, and cellulose derivatives. They may be used alone or as a mixture of two or more. Among them, polyester resins and vinyl resins are preferred.

Various release agents may be incorporated into the receptive layer from the viewpoint of preventing the receptive layer from being heat-fused to the thermal transfer image receiving sheet during the formation of an image. Release agents usable herein include phosphoric ester plasticizers, fluoro compounds, and silicone oils. Among them, silicone oils are preferred. Various modified silicones, including dimethyl silicone, may be used. Specific examples thereof include amino-modified silicone, epoxy-modified silicone, alcohol-modified silicone, vinyl-modified silicone, and urethane-modified silicone. Further, they may be used after blending or may be used after polymerization utilizing various reactions.

These release agents may be used alone or as a blend of two or more. The amount of the release agent added is preferably 0.5 to 30 parts by weight based on 100 parts by weight of the resin for the receptive layer. When the amount of the release agent added is outside the above range, problems often occur such as fusing between the thermal dye transfer sheet and the thermal transfer image receiving sheet and lowered printing sensitivity. Addition of the release agent to the receptive layer causes the release agent to bleed out on the surface of the receptive layer after the transfer to form a release layer. The release agent may be separately coated on the receptive layer without addition to the receptive layer.

In the formation of the receptive layer, a white pigment, a fluorescent brightener and the like may be added to improve the whiteness of the receptive layer and to further enhance the sharpness of the transferred image.

The receptive layer may be coated by a conventional method, such as roll coating, bar coating, gravure coating, gravure reverse coating, or extrusion coating. The coverage is preferably about 0.5 to 15 g/m$^2$ on a dry basis.

Preferably, the receptive layer may be formed as a continuous coating. Alternatively, the receptive layer may be formed as a discontinuous coating using a resin emulsion, a water-soluble resin, or a resin dispersion. Further, an antistatic agent may be coated on the receptive layer in order to stabilize the carrying in the thermal transfer printer.

An antistatic layer may be provided on the surface of the receptive layer or backside, or the outermost surface of both sides of the image receiving sheet. The antistatic layer may be formed by coating a solution or dispersion of an antistatic agent, such as a fatty ester, a sulfuric ester, a phosphoric ester, an amide, a quaternary ammonium salt, a betaine, an amino acid, an acrylic resin, or an ethylene oxide adduct, in a solvent. The antistatic layer may be formed by the same method as described above in connection with the formation of the receptive layer. The coverage of the antistatic layer is preferably 0.001 to 0.1 g/m$^2$ on a dry basis.

Intermediate layer

If necessary, an intermediate layer 9 may be provided between the receptive layer and the substrate. The intermediate layer may be formed of any material depending upon the purposes intended for the layer. For example, use of resins with various white pigments added thereto can offer high whiteness. Further, if necessary, fluorescent brighteners, antistatic agents and the like may be added.

The intermediate layer may be optionally provided in order to improve the adhesion between the substrate and the receptive layer. Further, in order to improve the adhesion, the substrate on its side where the receptive layer is to be formed may be previously subjected to corona discharge treatment and ozone treatment as pretreatment for the provision of the intermediate layer.

A layer formed of a thermoplastic resin, a thermosetting resin, or a thermoplastic resin having a functional group cured with various curing agents or using other methods may be used as the intermediate layer. Specifically, polyvinyl alcohol, polyvinyl pyrrolidone, polyester, chlorinated polypropylene, modified polyolefin, urethane resin, acrylic resin, polycarbonate, ionomer, or a resin prepared by curing a monofunctional- and/or polyfunctional hydroxyl-containing prepolymer with an isocyanate or the like may be used. If necessary, in order to impart whiteness, opacity or the like, titanium oxide, calcium carbonate, barium sulfate and other conventional inorganic pigments, organic fillers, fluorescent brighteners, and other additives may be added to these resins. The coating thickness is preferably about 0.5 to 30 $\mu$m.

Substrate

Various papers, synthetic papers, plastic sheets and the like may be used as the substrate 3 in the thermal transfer image receiving sheet. The receptor layer may be formed on the substrate directly or through a primer layer. In order to impart higher printing sensitivity and to obtain high quality free from uneven density and droplets, the presence of a layer 7 having microvoids is indispensable.

A plastic sheet or synthetic paper having therein microvoids may be used as the layer having microvoids. Alternatively, the layer having microvoids may be formed by various coating methods on various supports 6. A plastic sheet or a synthetic paper prepared by blending a polyolefin, particularly polypropylene, as a main component with an inorganic pigment and/or a polymer incompatible with polypropylene as a void formation initiator, and subjecting the mixture to stretching and film formation is preferred as the plastic sheet or synthetic paper having microvoids. When the plastic sheet or synthetic paper is composed mainly of a polyester or the like, due to the viscoelastic or thermal properties, the cushioning properties and heat insulating properties are inferior to those of the plastic sheet or synthetic paper composed mainly of polypropylene. Therefore, in this case, the printing sensitivity is poor and, at the same time, uneven density is likely to occur.

In view of the above facts, the modulus of elasticity of the plastic sheet and the synthetic paper is preferably $5\times10^8$ to $1\times10^{10}$ Pa at 20° C. The plastic sheet and the synthetic paper are generally formed by biaxial stretching. Therefore, they are shrunken upon heating. When they are allowed to stand at 110° C. for 60 sec, the shrinkage is 0.5 to 2.5%. The plastic sheet or the synthetic paper may have a single layer structure of a layer containing microvoids or a multi-layer structure of a plurality of layers. When they have a multi-layer structure, all the layers constituting the structure may contain microvoids or alternatively a layer not containing microvoids may be present. If necessary, a white pigment may be incorporated as an opacifying agent into the plastic sheet and the synthetic paper.

Further, an additive, such as a fluorescent brightener, may be added to increase the whiteness. The thickness of the layer having microvoids is preferably 30 to 80 $\mu$m.

The layer having microvoids may be formed on the support by coating. Plastic resins usable herein include polyester, urethane resin, polycarbonate, acrylic resin, polyvinyl chloride, polyvinyl acetate and other conventional resins. They may be used alone or as a blend of two or more.

The support 6 may be a conventional one, and examples thereof include various papers, such as wood free papers, coated papers, art papers, cast coated papers, and glassine papers, synthetic papers, unwoven fabrics, and plastic sheets of polyethylene terephthalate, acrylic resin, polyethylene, polypropylene and the like.

Various papers, synthetic papers, plastic sheets and the like may be used as the substrate. As described above, however, the substrate preferably comprises a microvoid layer provided on a support. In this case, when the microvoid layer is constituted by a plastic sheet or a synthetic paper, it may be laminated onto the support through an adhesive layer 8.

Lamination methods usable herein include, for example, dry lamination, nonsolvent (hot melt) lamination, EC lamination and other conventional lamination methods. Among them, dry lamination and nonsolvent lamination are preferred. Preferred adhesives suitable for the nonsolvent lamination include, for example, Takenate A-720L, manufactured by Takeda Chemical Industries, Ltd. Preferred adhesives suitable for the dry lamination include, for example, Takelac A969/Takenate A-5(3/1), manufactured by Takeda Chemical Industries, Ltd. The amount of these adhesives used may be about 1 to 8 g/m$^2$, preferably 2 to 6 g/m$^2$, on a solid basis.

Process for producing thermal transfer image receiving sheet

Next, the process for producing a thermal transfer image receiving sheet according to the present invention will be described. In the thermal transfer image receiving sheet 1 according to the present invention, in general, a coating liquid for a receptive layer is coated on one side of a previously provided substrate 3, and the coating is then dried to form a receptive layer 4. In this case, if necessary, prior to the formation of the receptive layer 4, a coating liquid for an intermediate layer may be coated on one side of the substrate 3 to form a coating which is then dried to form an intermediate layer 9, followed by formation of the receptive layer 4 on the intermediate layer 5.

A synthetic resin having a softening point of 110° C. or above may be extrusion-laminated onto the other side of the substrate 3 to form a grip layer 2 constituted by an unstretched synthetic resin layer on the substrate 3 on its side (backside) remote from the receptive layer 4 side. In this case, if necessary, a polyethylene resin layer 5 provided as a substrate layer for the grip layer may be coextrusion-laminated together with the synthetic resin having a softening point of 110° C. or above for constituting the grip layer.

Thus, according to the present invention, the spike 19 of the metallic roller 18 bites the grip layer 2 provided on the substrate 3, so that misregistration does not occur in the reciprocation of the thermal transfer image receiving sheet at the time of image formation. Therefore, the formed image is free from misregistration.

Formation of a grip layer using an unstretched synthetic resin layer having a softening point of 110° C. or above, preferably an unstretched polyolefin resin layer, most preferably an unstretched polypropylene resin layer, in combination with the provision of a polyethylene resin layer between the grip layer and the substrate can prevent the spike 19 from passing through the thermal transfer image receiving sheet 1 and can improve the print quality. In addition, this arrangement can improve the biting by the spike 19 and hence is very effective for preventing the misregistration.

The following examples and comparative examples further illustrate the present invention. In the following examples and comparative examples, all "parts" or "%" are by weight.

EXAMPLE 1

An intermediate layer and a receptive layer having the following respective composition were coated in that order on a 39 μm-thick microvoid film constituted by a microvoid layer, following by drying. Thereafter, an adhesive according to the following formulation was coated on the surface of the microvoid film remote form the receptive layer, and the coating was dried. Separately, a coated paper (186.1 g/m$^2$) as a support having a grip layer formed on one side thereof by the following method was provided. The above assembly was applied to the coated paper so that the adhesive layer faced the surface of the substrate remote from the grip layer. Thus, a thermal transfer image receiving sheet of Example 1 was prepared.

The coverage on a dry basis of the layers was 2 g/m$^2$ for the intermediate layer, 4 g/m$^2$ for the receptive layer, and 4 g/m$^2$ for the adhesive layer.

| | |
|---|---|
| Coating liquid for intermediate layer | |
| Polyester resin (WR-905, manufactured by Nippon Polyurethane Industry Co., Ltd.) | 13.1 parts |
| Titanium oxide (TCA888, manufactured by Tohchem Products Corporation) | 26.2 parts |
| Fluorescent brightener (Uvitex BAG, manufactured by Ciba-Geiby Limited, Japan) | 0.39 part |
| Water | 60.0 parts |
| Water/IPA = 1/1 | 32.0 parts |
| Coating liquid for receptive layer | |
| Vinyl chloride/vinyl acetate copolymer (Denka vinyl #1000A, manufactured by Denki Kagaku Kogyo K.K.) | 12.0 parts |
| Epoxy-modified silicone (X-22-3000T, manufactured by The Shin-Etsu Chemical) | 0.8 part |
| Amino-modified silicone (X-22-1660B-3, manufactured by The Shin-Etsu Chemical) | 0.24 part |
| Toluene/MEK = 1/1 | 60.0 parts |
| Coating liquid for adhesive layer | |
| Polyfunctional polyol (Takelac A-969V, manufactured by Takeda Chemical Industries, Ltd.) | 30 parts |
| Isocyanate (Takenate A-5, manufactured by Takeda Chemical Industries, Ltd.) | 10 parts |
| Ethyl acetate | 60 parts |
| (Formation of grip layer) | |
| The following grip layer was formed as a 33 μm-thick unstretched synthetic resin layer by extrusion lamination on the coated paper as the support. | |
| Grip layer | |
| Polypropylene resin (Jayaromer LR711-5, manufactured by Nippon Polyolefin) | |

EXAMPLE 2

In the thermal transfer image receiving sheet of Example 1, the following polyethylene resin layer was formed between the substrate and the grip layer. The resin for the grip layer was the same as that used in Example 1. A high-density polyethylene resin was used for the polyethylene resin layer. In this case, the grip layer and the polyethylene resin layer were formed by coextrusion lamination through a multi-manifold head so as to give a total thickness of 33 μm. At that time, the thickness of the polyethylene resin layer was 14 μm, while the thickness of the grip layer (unstretched polypropylene resin layer) was 19 μm. Other conditions were the same as those in Example 1. Thus, a thermal transfer image receiving sheet of Example 2 was prepared.

Polyethylene resin layer

High-density polyethylene resin (Jayrex LZO 139-5)

EXAMPLE 3

The procedure of Example 1 was repeated, except that the thickness of the microvoid film constituted by the microvoid layer was changed to 35 μm, the grip layer was formed using an unstretched synthetic resin layer of the following medium-density polyethylene resin in a thickness of 33 μm on the coated paper (127.9 g/m$^2$) as the support by extrusion lamination. Thus, a thermal transfer image receiving sheet of Example 3 was prepared.

Grip layer

Medium-density polyethylene resin (Sumikathene L5721, manufactured by Sumitomo Chemical Co., Ltd.)

EXAMPLE 4

The procedure of Example 2 was repeated, except that the basis weight of the coated paper as the support was changed to 157 g/m$^2$. Thus, a thermal transfer image receiving sheet of Example 4 was prepared.

COMPARATIVE EXAMPLE 1

The procedure of Example 1 was repeated, except that a 35 $\mu$m-thick biaxially stretched polypropylene film was laminated as the grip layer onto the support with the aid of the coating liquid for the adhesive layer used in Example 1. Thus, a thermal transfer image receiving sheet of Comparative Example 1 was prepared.

COMPARATIVE EXAMPLE 2

The procedure of Example 2 was repeated, except that the substrate having thereon the polyethylene resin layer and the grip layer was changed to a 125 $\mu$m-thick transparent polyethylene terephthalate film. Thus, a thermal transfer image receiving sheet of Comparative Example 2 was prepared.

COMPARATIVE EXAMPLE 3

The procedure of Comparative Example 2 was repeated, except that the 125 $\mu$m-thick transparent polyethylene terephthalate film was changed to a 125 $\mu$m-thick white polyethylene terephthalate film. Thus, a thermal transfer image receiving sheet of Comparative Example 3 was prepared.

The thermal transfer image receiving sheets of the above examples and the comparative examples were used to form images by thermal transfer under the following conditions.

Specifically, color images were formed using a thermal transfer sheet (for CP-700, manufactured by Mitsubishi Electric Corporation) having three color dye layers of yellow, magenta, and cyan in a face serial manner and each of the thermal transfer image receiving sheets by means of a thermal transfer printer (CP-700, manufactured by Mitsubishi Electric Corporation). In this case, the printer was of a type as shown in FIG. 3 wherein the thermal transfer image receiving sheet is carried by means of a grip roller 16.

(Evaluation method)

In the images formed under the above image forming conditions, misregistration among three colors of yellow, magenta, and cyan was inspected under a microscope.

The results were evaluated according to the following criteria.

○: Misregistration of less than 100 $\mu$m (good level)

Δ: Misregistration of 100 to less than 200 $\mu$m (not good but still on acceptable level)

X: Misregistration of not less than 200 $\mu$m (unacceptable level)

Evaluation results are summarized in the following table 1.

TABLE 1

| | Misregistration |
|---|---|
| Ex. 1 | ○ |
| Ex. 2 | ○ |
| Ex. 3 | Δ |
| Ex. 4 | ○ |
| Comp. Ex. 1 | x |
| Comp. Ex. 2 | x |
| Comp. Ex. 3 | x |

In Example 1 wherein an unstretched polypropylene resin layer having a softening point of 110° C. or above was used as the grip layer, the evaluation on the misregistration was very good. In Example 2 wherein the backside of the image receiving sheet had a laminate structure formed by coextrusion lamination of the grip layer and the polyethylene resin layer, although the thickness of the unstretched polypropylene resin layer as the grip layer is somewhat small, it is considered that the provision of the polyethylene resin layer formed of a high-density polyethylene resin as a substrate layer created good biting by the spike.

For Example 3, the misregistration was somewhat poor but still on an acceptable level. It is considered that since the grip layer formed of an unstretched medium-density polyethylene resin is somewhat rigid, the biting by the spike has become somewhat poor.

As with Example 2, for Example 4, it is considered that good biting by the spike was achieved.

For Comparative Example 1, the spike did not satisfactorily bite the stretched polypropylene film, resulting in poor level of the evaluation on the misregistration. For Comparative Examples 2 and 3 wherein the grip layer was constituted by a stretched polyethylene terephthalate film, the spike did not satisfactorily bite, resulting in poor level of the evaluation on the misregistration.

As described above, the thermal transfer image receiving sheet of the present invention comprises a substrate, a receptive layer provided on at least one side of the substrate, and a grip layer provided on the other side of the substrate. In this case, the grip layer is constituted by an unstretched synthetic resin layer having a softening point of 110° C. or above. This constitution permits a spike of a metallic roller in a printer to satisfactorily bite the unstretched synthetic resin layer having a softening point of 110° C. or above as the grip layer. This prevents slippage between the metallic roller and the thermal transfer image receiving sheet at the time of a reciprocation for image formation and hence can prevent misregistration. Therefore, the thermal transfer image receiving sheet can be carried with improved accuracy, and a thermal transfer image can be formed without misregistration.

Further, the process for producing a thermal transfer image receiving sheet according to the present invention comprises the steps of: a forming a receptive layer on at least one side of the substrate; and extrusion-laminating a synthetic resin having a softening point of 110° C. or above on the other side of the substrate to form a grip layer constituted by an unstretched synthetic resin layer. The extrusion lamination of the synthetic resin having a softening point of 110° C. or above permits a grip layer of a synthetic resin in an unstretched state to be easily formed on the other side of the substrate. This unstretched layer of the synthetic resin is easily bitten by the spike. Thus, the process of the present invention can easily form a thermal transfer image receiving sheet which can form a thermally transferred image without misregistration.

Further, formation of a thermal transfer image receiving sheet having a polyethylene resin layer and an unstretched synthetic resin layer as a grip layer by coextrusion-laminating of a polyethylene resin and a synthetic resin having a softening point of 110° C. or above on at least one side of the substrate is preferred. Since the polyethylene resin layer, which can improve the adhesion between the substrate and the grip layer and at the same time can prevent a trace of the spike from reaching the image receiving face, can be easily formed by coextrusion lamination together with the grip layer which can be well bitten by the spike. This can realize the formation of a thermally transferred image without misregistration and the formation of a thermally transferred image free from a trace of a spike and having good quality.

What is claimed is:

1. A thermal transfer image receiving sheet comprising:

a substrate;

a receptive layer provided on at least one side of the substrate; and a grip layer provided on the other side of the substrate, the grip layer being constituted by an unstretched polyproplene resin layer having a softening point of 110° C. or above and having a thickness of 15 to 50 $\mu$m.

2. The thermal transfer image receiving sheet according to claim 1, wherein a polyethylene resin layer is provided between the substrate and the grip layer.

3. The thermal transfer image receiving sheet according to claim 2, wherein the polyethylene resin layer and the grip layer have been formed by coextrusion lamination.

4. The thermal transfer image receiving sheet according to claim 1, wherein the grip layer has been formed by extrusion lamination.

5. A process for producing a thermal transfer image receiving sheet, comprising the steps of:

forming a receptive layer on at least one side of a substrate; and extrusion-laminating a polyproplene resin having a softening point of 110° C. or above on the other side of the substrate to form a grip layer constituted by an unstretched polyproplene resin layer having a thickness of 15 to 50 $\mu$m.

6. The process according to claim 5, wherein, in the step of the extrusion lamination, a polyethylene resin and a polyproplene resin having a softening point of 110° C. or above are coextrusion-laminated on at least one side of the substrate to prepare a thermal transfer image receiving sheet comprising a polyethylene resin layer and a grip layer constituted by an unstretched polyproplene resin layer.

* * * * *